US005144275A

United States Patent [19]

Sebastian et al.

[11] Patent Number: 5,144,275

[45] Date of Patent: Sep. 1, 1992

[54] POSITIONING CYLINDER, ESPECIALLY FOR SUBTERRANEAN MINING

[75] Inventors: Lothar Sebastian, Bochum; Karl-Heinz Berger, Herten-Langenbochum; Friedel Amling, Gelsenkirchen-Horst; Gerhard Hecken, Bochum, all of Fed. Rep. of Germany

[73] Assignee: Bochumer Eisenhutte Heintzmann GmbH & Co. KG, Bochum, Fed. Rep. of Germany

[21] Appl. No.: 647,822

[22] Filed: Jan. 30, 1991

[30] Foreign Application Priority Data

Feb. 3, 1990 [DE] Fed. Rep. of Germany ..... 4003151

[51] Int. Cl.[5] ..... H01C 13/00

[52] U.S. Cl. ..... 338/67; 338/39; 338/151; 338/180; 338/196; 73/453

[58] Field of Search ..... 338/36, 39, 67, 33, 338/196, 143, 148, 151, 180; 73/1 E, 290 R, 453

[56] References Cited

U.S. PATENT DOCUMENTS 1,795,707 3/1931 Blymer ..... 338/67 X 2,203,523 6/1940 Cunningham ..... 338/33

*Primary Examiner*—Marvin M. Lateef

*Attorney, Agent, or Firm*—Herbert Dubno

[57] ABSTRACT

A positioning cylinder assembly for subterranean mining applications has a rotary potentiometer connected through a friction wheel transmission with the spindle of the cylinder which is rotated when the piston is axially displaced therein. The friction wheel assembly comprises a pinion wheel connected to the spindle and a hollow wheel connected to the rotary potentiometer, that not only matches the pitch of the spindle to the rotary spring of the potentiometer but also functions as a slip clutch for zero setting of the potentionmeter and the piston.

4 Claims, 2 Drawing Sheets

POSITIONING CYLINDER, ESPECIALLY FOR SUBTERRANEAN MINING

FIELD OF THE INVENTION

Our present invention relates to a positioning cylinder, especially for use in underground mining applications, which is provided with a measuring system for measuring and signaling the displacement of the piston rod relative to the cylinder. More particularly, the invention relates to a system of this type in which a cylinder receives a piston and piston rod and the assembly has a positioning-measuring unit including a spindle rotatable by the advance of the piston, a friction clutch connecting the spindle to a rotary potentiometer and a nut for the spindle insuring that relative axial displacement of the cylinder and piston will rotate the piston. The spindle and spindle nut on the one hand and the rotary potentiometer on the other hand are so arranged that the change in resistance of the potentiometer will represent a specific displacement of the piston. The potentiometer can be connected to circuitry for control of the displacement of the piston and/or signaling the displacement.

BACKGROUND OF THE INVENTION

In mining applications it is frequently necessary to provide positioning cylinder assemblies, e.g. for the advance of a tool, for control of the stroke of an implement, for properly positioning a prop or the like or for a variety of other purposes.

For the most part, it is important that the one or more positioning cylinder assemblies have a position measuring device or means capable of signaling to a remote location, for control or display, the displacement of the piston within the cylinder.

For that purpose, positioning cylinder assemblies have been developed in which a piston carrying a piston rod is displaceable in the cylinder by a fluid medium, a spindle is rotatable in the cylinder and has a helical formation engaged by a nut or the like connected to the piston rod and the spindle is connected, in turn, through a friction clutch with a rotary potentiometer.

The axial displacement of the piston rod relative to the cylinder causes the nut to be axially displaced relative to the spindle and thus rotatably drives the spindle with a number of revolutions which depends upon the axial displacement of the piston.

The conventional positioning cylinder of this type has the spindle and the input shaft of the rotary potentiometer coaxial and synchronously driven. The friction coupling between them comprises a sleeve-like component which is connected with the spindle and a connecting pin engageable in the sleeve-like component and forming an extension of the input shaft of the rotary potentiometer. The connecting pin has an elastically yieldable coupling ring which functions as the friction clutch. The friction clutch is provided to allow a zero setting of the potentiometer to be matched with a zero or starting position of the piston or cylinder. This can be achieved by hand. The earlier positioning cylinder as described has been found to be satisfactory by and large. However, it has been found that the elastomeric coupling ring is sensitive to aging and, upon uncontrolled aging, the frictional connection can be altered. As a consequence, the zero positions can change and the accuracy of the signalled measurement can decrease.

Furthermore, in subterranean mining applications, positioning cylinders of different strokes are necessary. If a rotary potentiometer with a limited rotary stroke is provided with a friction clutch it is frequently necessary to adapt it to the positioning cylinder by replacing the spindle by utilizing a spindle and nut of a different pitch. The replacement of a spindle and nut in the cylinder assembly is an expensive and time consuming proposition.

In general, the cost can be reduced by utilizing as the spindle, a square-cross section bar which is provided with its helical formations by twisting the bar so that the edges thereof define the screw threads of helical pattern. For cylinders of different strokes, the different pitches are established by different degrees of twist. Such spindles, however, are not exact and thus the cost saving through the use of such spindles must be at the expense of precision. Indeed, in modern measurement and controlled systems, the inaccuracies introduced by such spindles are no longer acceptable.

OBJECTS OF THE INVENTION

It is, therefore, the principal object of the present invention to provide an improved positioning cylinder assembly whereby the aforementioned disadvantages are obviated.

A more specific object of this invention is to provide a positioning cylinder which affords a more exact measurement of the displacement of the piston via the rotary potentiometer.

Still another object of the invention is to provide a positioning cylinder assembly with simplified means for adjustment of the potentiometer stroke to the stroke of the piston and hence to the particular spindle.

It is also an object of this invention to provide a positioning cylinder assembly which allows its rotary potentiometer to be associated with cylinders utilizing different strokes as is the case particularly in subterranean mining applications.

SUMMARY OF THE INVENTION

These objects and others which will become apparent hereinafter are attained, in accordance with the invention in a positioning cylinder assembly, especially for subterranean mining, which comprises:

a fluid-operated cylinder;

a piston axially displaceable in the cylinder and having a piston rod, one of the cylinder and the piston being connectable to a load; and position-measuring means for measuring a displacement of the piston relative to the cylinder, the position-measuring means comprising:

a threaded spindle having a predetermined pitch and rotatable relative to the cylinder and a nut threadedly engaging the spindle, the nut and the spindle being relatively axially displaced upon displacement of the piston in the cylinder to rotate the spindle upon axial displacement of the piston, a rotary potentiometer on the cylinder rotatable to signal displacement of the piston and having a limited rotary stroke, and a friction-wheel transmission having an input-rotation/output-rotation ratio interconnecting the spindle and the potentiometer for matching the pitch of the spindle with the rotary stroke of the potentiometer and additionally forming a slip clutch between the spindle and the rotary potentiometer.

Consequently, between the spindle and the rotary potentiometer, a friction wheel transmission is provided which can match the pitch of the screw thread of the spindle to the rotary stroke of the potentiometer and which also serves as the friction clutch.

The friction wheel transmission is composed of materials, in accordance with the invention, which are sufficiently aging resistant. For example, all of the frictionally engaged parts can be composed of metal.

The transmission ratio can be set without difficulty by simple replacement of the pinion wheel with another of a different diameter so that prefabricated spindles of any desired pitch can be used, especially precision spindles with a given pitch, to enhance the precision of the measurement.

Simultaneously, the friction wheel transmission functions as a slip clutch to allow setting of the zero point.

In accordance with an important feature of the invention, the rotary potentiometer and the friction clutch can be received in a cylinder head unit which can be replaceably mounted on the cylinder and can be used with an assortment of cylinders of different strokes as a standardized unit. To set the transmission for the particular stroke, it is merely necessary to replace the friction wheel pinion on the spindle.

It has been found to be advantageous to provide the friction wheel transmission from a friction wheel pinion mounted on the spindle and a hollow wheel connected to the shaft of the rotary potentiometer and having an internal friction surface engaged by the pinion. The hollow wheel with its internal friction surface thus functions like an internally toothed gear having uniform microscopic toothing which, however, allows slip for zero point adjustment.

According to a feature of the invention, the rotary potentiometer is mounted on a rocker or lever which is swingable about an axis parallel and to a spindle axis biased by a spring pressing the hollow wheel against the pinion wheel.

This embodiment allows a hollow wheel to cooperate with friction pinion wheels as long as the friction pinion wheel can fit into the hollow wheel, i.e. with a wide variety of pinion wheel diameters.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
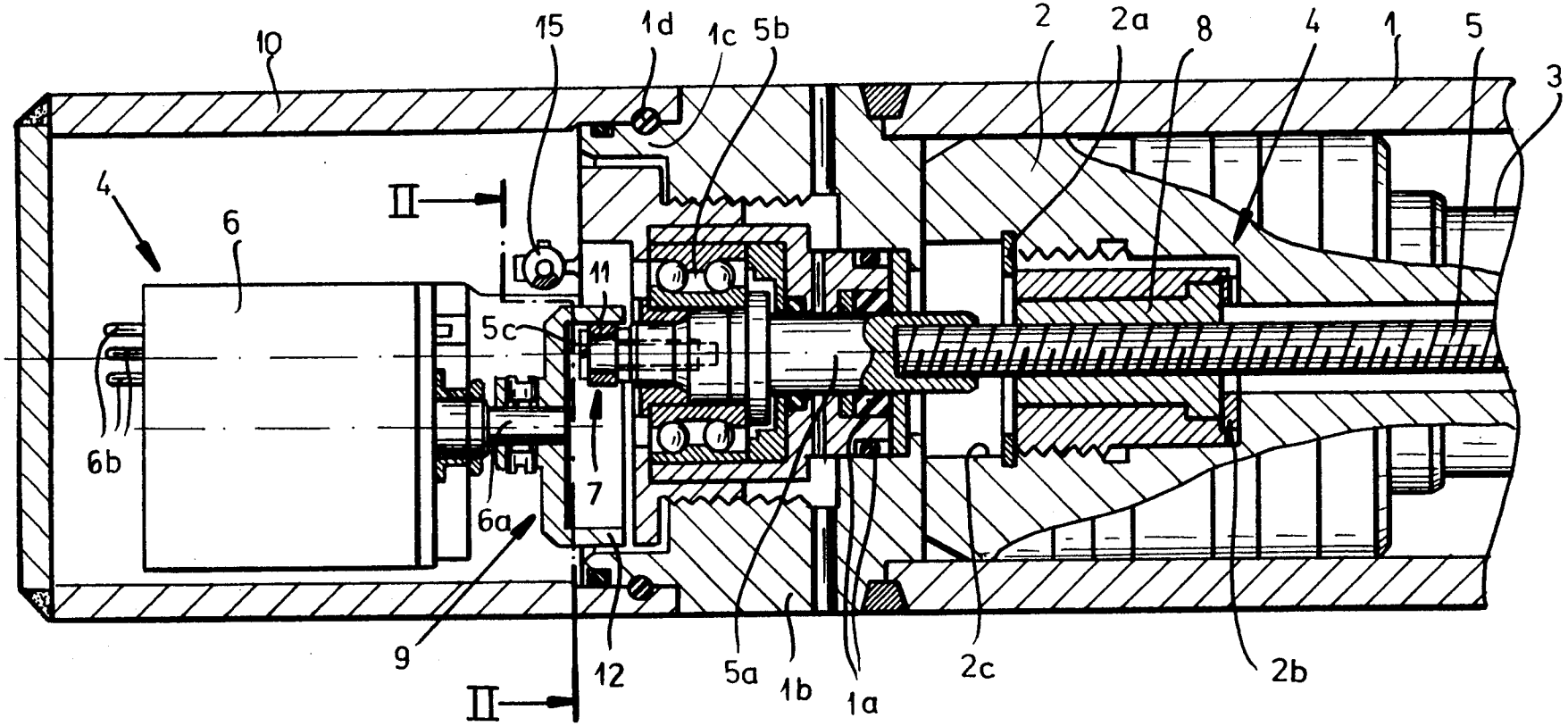
FIG. 1 is an axial cross sectional view through a positioning cylinder assembly according to the invention.

The positioning cylinder assembly shown in the drawing is especially effective for use in subterranean applications for the operation of a load connected to the piston rod with accurate positioning of that load. The head unit of the assembly is designed to be connected as a modular unit to other cylinders with different strokes as required and serves to signal the axial displacement with the cylinders being matched to the head units by selection of the friction pinion wheels of appropriate diameters.

The cylinder assembly basically comprises a cylinder 1, a piston 2 with its piston rod 3 and the displacement measuring device 4. The displacement measuring device 4 comprises a spindle 5 having a screw thread of predetermined pitch thereon axially fixed in a holder 5*a* which is mounted, in turn, in a bearing 5*b* so as to be freely rotatable. Seals 1*a* seal the cylinder with respect to the holder 5*a* and the end 1*b* of the cylinder is provided with a boss 1*c* in which a spring ring 1*d* can be received to hold the cylinder head unit 10 thereon. A rotary potentiometer 6 is provided to measure the rotary displacement of the spindle and hence the stroke of the piston and can be a Helipot type rotary potentiometer having a stroke over the full range of the potentiometer of 10 revolutions.

The rotary potentiometer 6 is connected to the spindle 5 by a slip clutch represented generally at 7. The spindle 5 is threadedly engaged by a nut 8 which is clamped between a ring 2*a* and a ring 2*b* in a recess 2*c* of the piston and is held against rotary movement therein. Thus an axial displacement of the piston 2 with the nut 8 relative to the spindle 5 will cause a rotation thereof to an extent depending upon the pitch of the screwthread.

According to the invention, between the spindle 5 and the rotary potentiometer 6, we provide a friction wheel transmission 9 with which the pitch of the spindle 5 is mounted to the rotary stroke of the potentiometer 6. The friction wheel transmission 9 simultaneously forms the friction clutch allowing the zero point adjustment as previously described.

In the embodiment illustrated and in the best mode embodiment of the invention, the rotary potentiometer 6 is received in the head unit 10 which is replaceably mounted on the cylinder 1 and the friction wheel transmission 9 is likewise received therein.

Figure 2:
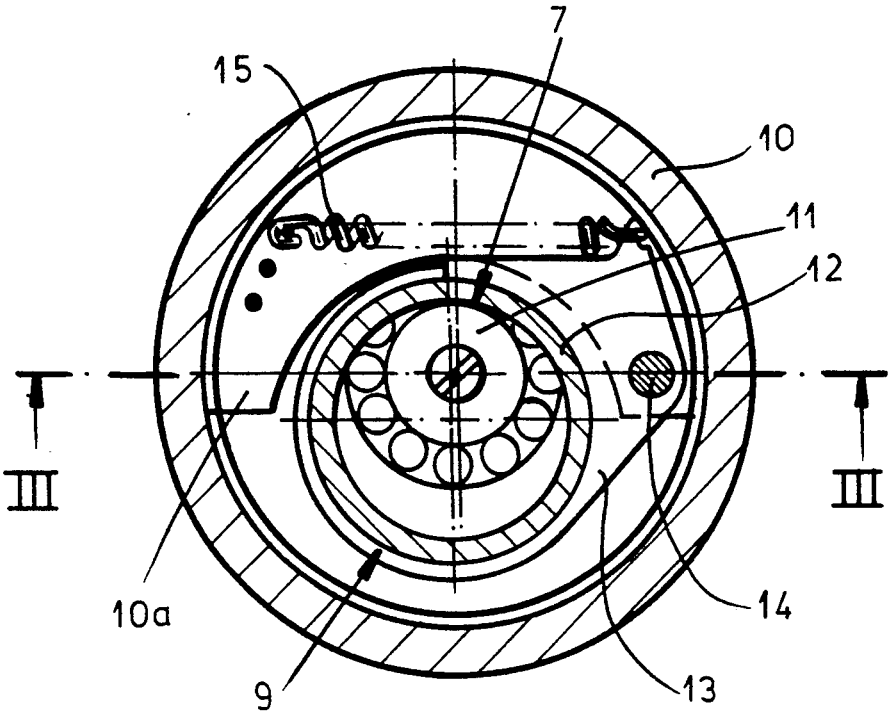
FIG. 2 is a section taken along the line II—II of FIG. 1.

As can be seen from FIGS. 1 and 2, the friction wheel transmission 9 comprises a friction pinion wheel 11 and a hollow wheel 12 with an internal friction surface.

The pinion wheel 11 is connected to the spindle 5 via a bolt 5*c* which can be removed to permit change of the friction wheel 11 for a friction wheel of a different diameter depending upon the transmission ratio of the transmission desired.

Figure 3:
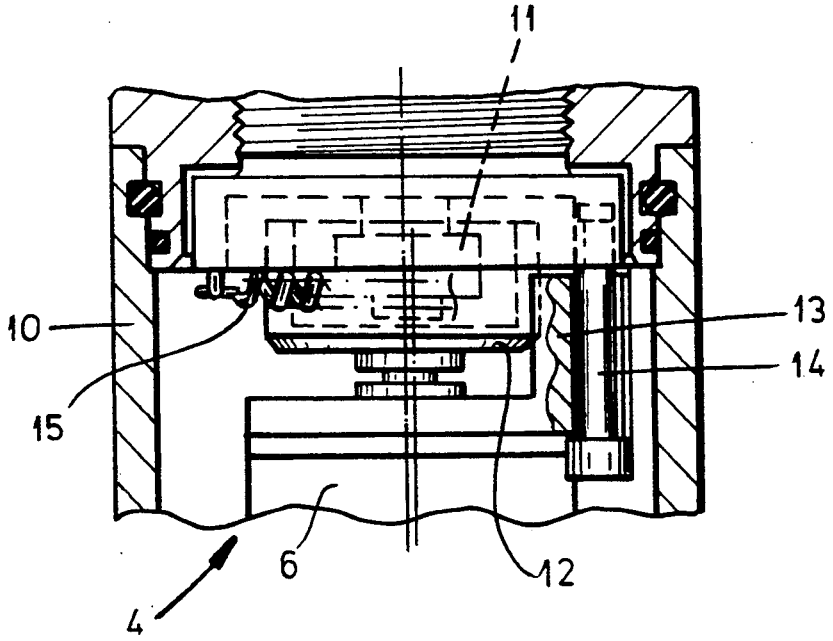
FIG. 3 is a cross sectional view taken along the line III—III of FIG. 2.

The rotary potentiometer 6 is mounted in a rocker 13 which is swingable about an axis 14 parallel to the spindle axis (see especially FIGS. 2 and 3). The rocker 13 is biased by a tension spring 15 anchored to the rocker and a mount 10*a* connected to the head 10. The spring 15 generates the requisite pressure of the wheel 12 upon the wheel 11 to achieve the frictional coupling of the two.

It will be apparent that, as the piston 2 is displaced, the spindle 5 is rotated to drive the wheel 11 and rotate the potentiometer shaft 6*a* more slowly in accordance with the transmission ratio. The potentiometer can be connected by its terminals 6*b* to a display or control circuit. The entire head 10 can be mounted replaceably on a variety of cylinders 1 with different strokes and the matching of the stroke to the stroke of the potentiometer can be accomplished simply by selection of the pinion 11 which is used. The compensatory movement of the wheel 12 for different diameters of the pinions is accomplished by the rocker 13 and spring 15.

We claim:

1. A positioning cylinder assembly, especially for subterranean mining, comprising:

a fluid-operated cylinder, said cylinder formed with cylindrical walls along an axial direction;

a piston having piston walls in slidable contact with said cylinder walls axially displaceable in said cylinder and having a piston rod, one of said cylinder and said piston being connectable to a load; and position-measuring means for measuring a displacement of said piston relative to said cylinder, said position-measuring means comprising:

a threaded spindle having a predetermined pitch and rotatable relative to said cylinder along a spindle axis and a nut threadedly engaging said spindle, said nut and said spindle being relatively axially displaced upon displacement of said piston in said cylinder to rotate said spindle upon axial displacement of said piston, a rotary potentiometer on said cylinder rotatable to signal displacement of said piston and having a limited rotary stroke, a friction-wheel transmission having an input-rotation/output-rotation ratio interconnecting said spindle and said potentiometer for matching the pitch of said spindle with the rotary stroke of said potentiometer and additionally forming a slip clutch between said spindle and said rotary potentiometer; and a rocker carrying said rotary potentiometer and pivotal about an axis parallel to said spindle axis, and a spring connected to said rocker providing tension thereunto.

2. The positioning cylinder assembly defined in claim 1 wherein said cylinder is provided with a cylinder head unit affixed to said cylinder, and said rotary potentiometer and said friction-wheel transmission are received in said cylinder head.

3. The positioning cylinder assembly defined in claim 2 wherein said friction-wheel transmission comprises a friction pinion wheel connected to said spindle and a hollow wheel having an internal friction surface engaged frictionally by said pinion wheel, said hollow wheel being connected to said potentiometer.

4. The positioning cylinder assembly defined in claim 3 wherein said cylinder head unit is constructed and arranged to be affixed to cylinders having different strokes and said pinion wheel is replaceable to adapted the rotary potentiometer of the head unit to the stroke of the cylinder to which the head unit is attached.

* * * * *